US009828891B2

(12) United States Patent
Oh et al.

(10) Patent No.: US 9,828,891 B2
(45) Date of Patent: Nov. 28, 2017

(54) CVVT SYSTEM

(71) Applicants: HYUNDAI MOTOR COMPANY, Seoul (KR); KIA MOTORS CORPORATION, Seoul (KR)

(72) Inventors: Chung Han Oh, Seongnam-si (KR); Min Su Park, Paju-si (KR); Yun Seok Kim, Yongin-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 98 days.

(21) Appl. No.: 14/937,426

(22) Filed: Nov. 10, 2015

(65) Prior Publication Data

US 2016/0376945 A1 Dec. 29, 2016

(30) Foreign Application Priority Data

Jun. 26, 2015 (KR) ..... 10-2015-0091596

(51) Int. Cl.

| | |
|---|---|
| ***F01L 1/34*** | (2006.01) |
| ***F01L 1/344*** | (2006.01) |
| *F01L 1/047* | (2006.01) |

(52) U.S. Cl.

CPC ..... *F01L 1/34409* (2013.01); *F01L 1/3442* (2013.01); *F01L 2001/0475* (2013.01); *F01L 2001/0476* (2013.01); *F01L 2001/34433* (2013.01); *F01L 2001/34463* (2013.01); *F01L 2001/34469* (2013.01)

(58) Field of Classification Search

CPC ..... F01L 1/34; F01L 1/3442; F01L 1/34409; F01L 2001/0476; F01L 2001/34433

USPC ..... 123/90.15, 90.17

See application file for complete search history.

(56) References Cited

U.S. PATENT DOCUMENTS 8,146,550 B2 * 4/2012 Takemura ..... F01L 1/022 123/90.15

FOREIGN PATENT DOCUMENTS

| | | |
|---|---|---|
| JP | 2003-286813 | 10/2003 |
| JP | 2007-132272 | 5/2007 |
| JP | 2009-168038 | 7/2009 |
| JP | 2010-190159 | 9/2010 |
| KR | 10-2009-0051577 | 5/2009 |

* cited by examiner

*Primary Examiner* — Ching Chang

(74) *Attorney, Agent, or Firm* — Brinks Gilson & Lione

(57) ABSTRACT

The present disclosure provides a CVVT system including: an OCV supplying oil received from a cylinder block into a CVVT; an oil supply unit supplying oil from the OCV to a lock pin; and an actuator selectively opening or closing the oil supply unit such that oil is supplied to the lock pin and the lock pin is separated from a lock pin hole when the oil supply unit is opened.

9 Claims, 7 Drawing Sheets

CVVT SYSTEM

CROSS-REFERENCE TO RELATED APPLICATION

The present application claims the benefit of Korean Patent Application No. 10-2015-0091596, filed Jun. 26, 2015, which is incorporated herein by reference in its entirety.

FIELD

The present disclosure relates to a CVVT (Continuous Variable Valve Timing) system.

BACKGROUND

The statements in this section merely provide background information related to the present disclosure and may not constitute prior art.

In general, a CVVT system continuously changes opening/closing timings by changing the phase of a camshaft in accordance with the revolution per minute (RPM) of an engine and the load on a vehicle. In general, the CVVT systems largely include a crank angle sensor that senses a rotational angle of a crankshaft, a cam angle sensor that senses a rotational angle of a camshaft, a variable valve timing unit that is connected to a side of a camshaft through a timing belt and advances or retards the camshaft, and an ECU that controls an OCV (Oil Control Valve) so that oil is supplied to an advancing chamber or a retarding chamber of the variable valve timing unit in response to signals from the crank angle sensor and the cam angle sensor.

The variable valve timing unit comprises a stator connected by a timing belt to receive torque from the crankshaft and a vane-shaped rotor integrally combined with the camshaft and rotating relative to the stator. A chamber divided into the advancing chamber and the retarding chamber by the rotor is formed in the stator, so when oil is supplied into the advancing chamber through the OCV, a phase difference is generated between the rotor and the stator and the camshaft rotates, and thus, the timing of a valve changes. On the contrary, when oil is supplied into the retarding chamber through the OCV, a phase difference is generated between the rotor and the stator in the opposite direction to that when oil is supplied into the advancing chamber, so the timing of the valve is retarded.

Further, a lock pin is formed on the rotor to fix the rotor to the stator when an engine stops, and a locking hole for locking the lock pin is formed in the stator. The ECU adjusts valve timing for the cam in accordance with a crank position in response to signals from the crank angle sensor and the cam angle sensor. When the OCV allows the cam to rotate in response to a control signal from the ECU, the cam angle sensor detects the position of the camshaft and feeds it back to the ECU. The ECU estimates the amount of rotation of the cam on the basis of the fed-back position information of the camshaft and transmits a signal for controlling the position of the camshaft back to the OCV on the basis of the estimated amount of rotation of the cam. The CVVT systems are controlled by this control logic.

On the other hand, in order to smoothly perform the feedback function, a control logic for the OCV according to the crank position and the cam position is mapped in the ECU, and when the mapped position of the camshaft and the cam position detected by the cam angle sensor are different, the ECU controls an oil control valve, so the rotation of the camshaft is increased/decreased.

In an intermediate phase of CVVT, a lock pin on the rotor is locked into a lock pin hole between the advancing chamber and the retarding chamber while the RPM of an engine is reduced, thereby preparing for later engine start. The action that the lock pin is automatically locked into the lock pin hole while the RPM of an engine reduces is called 'self-lock'.

The self-lock is a function that allows CVVT can mechanically return to an accurate position without specific adjustment so that operational stability of an engine can be maintained in other periods except for the operation period of the CVVT, that is, when the engine is idling or started.

However, when the valve timing reaches the most retarded position, not returning to the intermediate phase and an engine of a vehicle is idling, a surge tank is not vacuumized and the internal pressure of the surge tank increases up to the atmospheric pressure, so the performance of a brake using the vacuum of the surge tank is deteriorated.

Further, when the valve timing reaches the most retarded position, not returning to the intermediate phase, excessive overlap of valve timing is generated between an intake valve and an exhaust valve, so the operational stability of the engine decreases and vibration of the engine increases, and in some cases, the engine stops.

In particular, when an Atkinson cycle is applied to a vehicle, it is desired to retard the timing of closing the intake valve, using a CVVT, in order to maximize the effect of the Atkinson cycle, but an intake CVVT of the related art is fixed to the most retarded position for starting and idling, so compressive pressure is insufficient and the engine is not normally started. Accordingly, when such an engine is started or is idling, it is possible to set the timing of an intake valve to a common MPI (Multi-Position Injection) level, and the engine may have a system that retards the timing of the intake valve in a certain period where fuel efficiency can be improved.

That is, an intermediate phase CVVT system has a basic position at an intermediate position and retards intake valve timing while a vehicle is driven, so an intermediate phase CVVT of the related art can be applied only to a V-6 type or horizontal engine in the way of controlling an intermediate phase using cam torque.

SUMMARY

The present disclosure provides a CVVT system that improves fuel efficiency in an inline 4 cylinder engine without stopping the engine or causing a problem in idling, by using intermediate phase CVVT using an improved hydraulic CVVT system.

According to one aspect of the present disclosure, there is provided a CVVT system including: an OCV supplying oil received from a cylinder block into a CVVT; an oil supply unit supplying oil from the OCV to a lock pin; and an actuator selectively opening or closing the oil supply unit such that oil is supplied to the lock pin and the lock pin is separated from a lock pin hole when the oil supply unit is opened.

The oil supply unit may be an oil channel allowing oil supplied to a cam journal from the OCV to flow to the lock pin.

The oil supply unit may be a valve bolt that has a spool therein and forms an oil channel between the oil supply unit and a cam journal when the spool is operated.

The spool of the oil supply unit may be pressed and operated by the actuator, so an oil channel allowing oil to flow to the lock pin may be formed.

A plurality of lock pins may be provided at predetermined distances from each other.

The lock pins may have different lashes, so locking speeds of the lock pins may be different.

The lock pins may have different lashes, so fixing forces of the lock pins may be different.

The lashes may be distances between the lock pins and the lock pin holes.

According to the CVVT system of the present disclosure, an intermediate phase CVVT system is provided that can be applied to an inline 4 cylinder engine. Further, a valve timing is positioned at an intermediate position in non-operation period of a CVVT such as in stopping or idling of an engine, so stopping an engine or a problem in idling is prevented, and LIVC (Lift Intake Valve Closing) is performed by operating the CVVT while a vehicle is driven, and accordingly, fuel efficiency is improved.

Further, it is possible to retard an exhaust valve and advance and retard an intake valve, so an engine can be operated in a desired state and the lifespan of the engine can be increased. Furthermore, valve overlap can be freely set, so fuel efficiency is improved.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
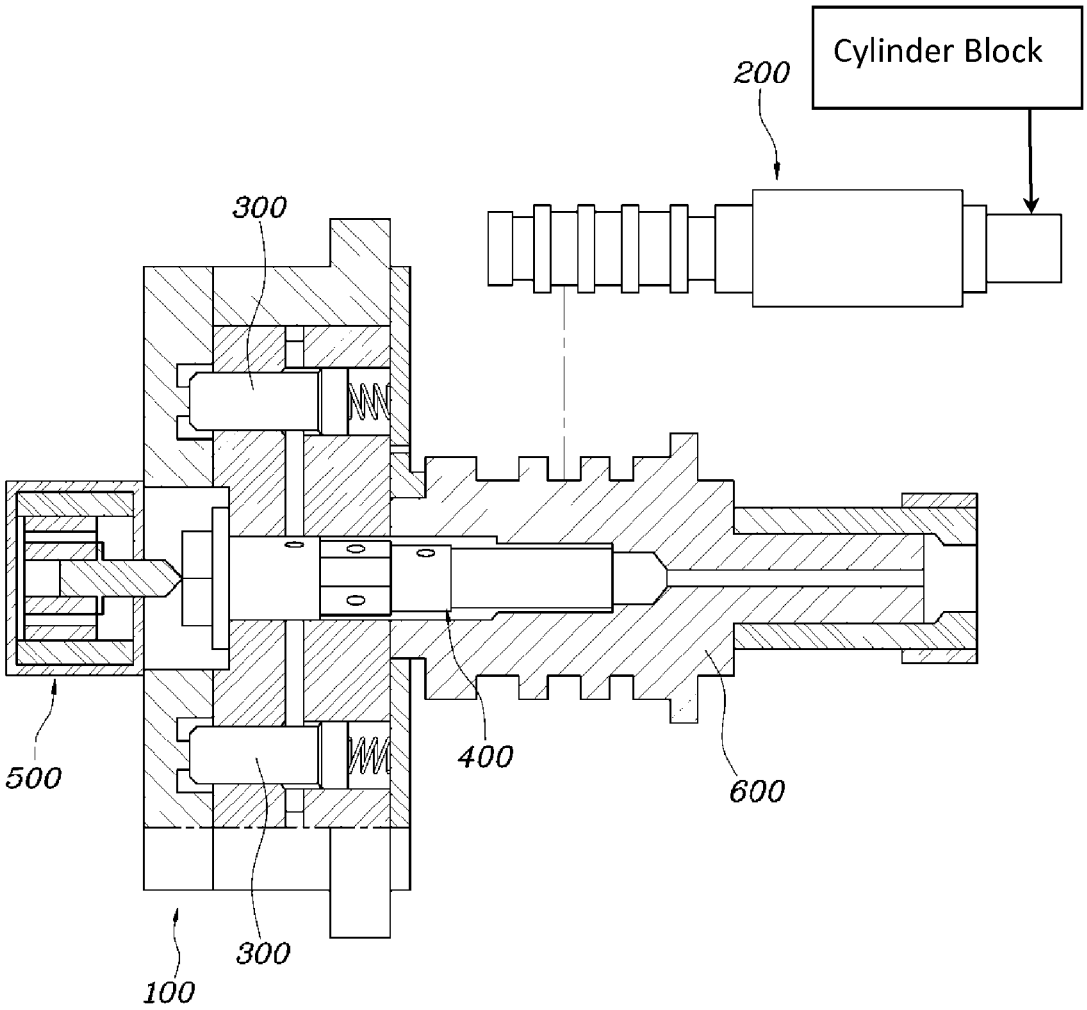
FIG. 1 is a view showing a CVVT system according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

Figure 2:
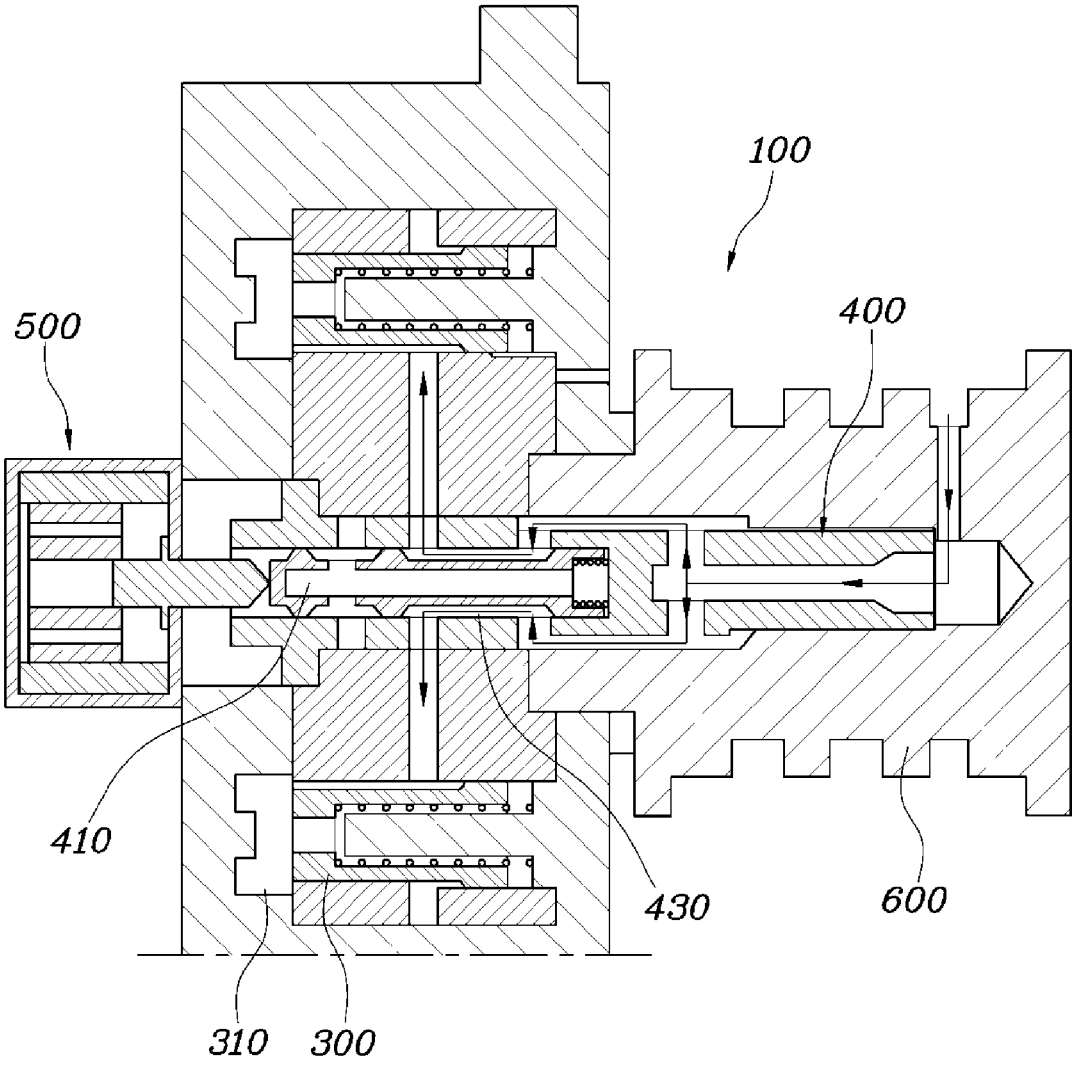
FIGS. 2 and 3 are views showing oil flow, when an actuator is operated/stopped.
Figure 3:
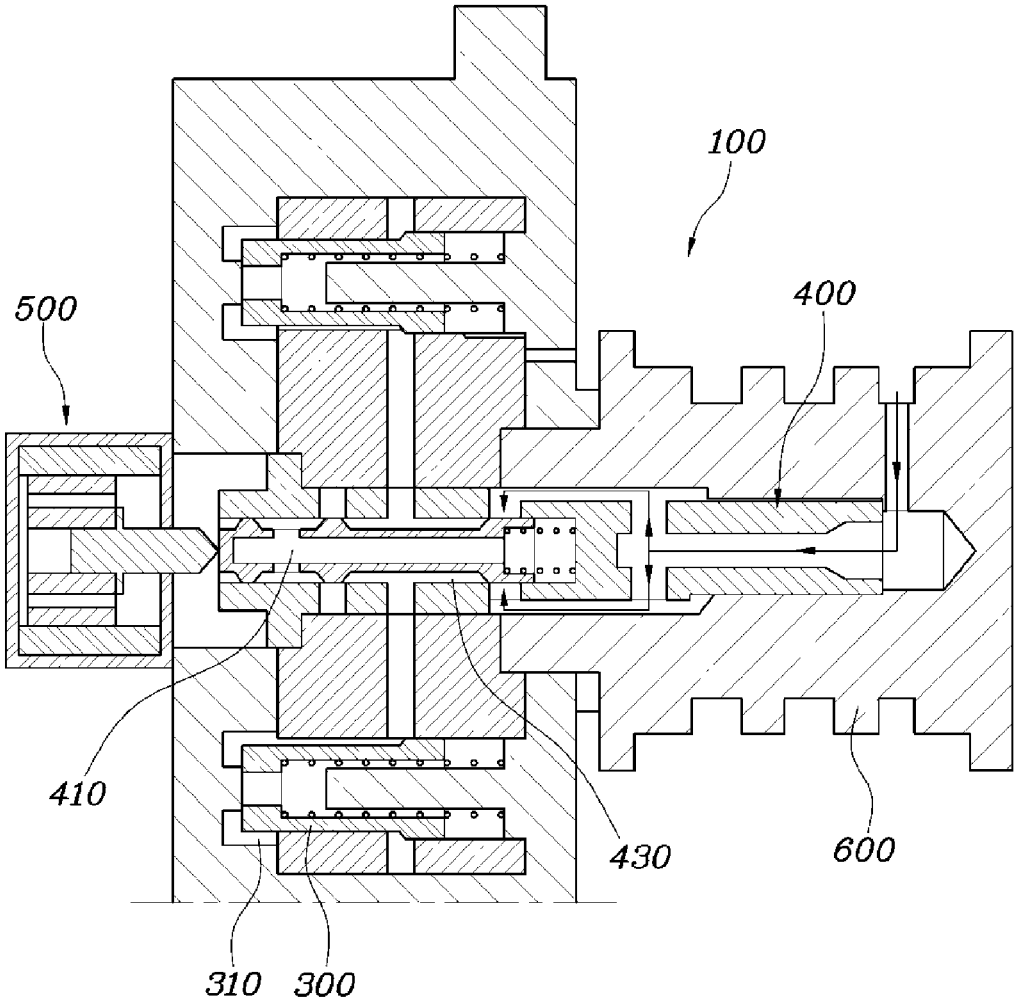
Figure 4:
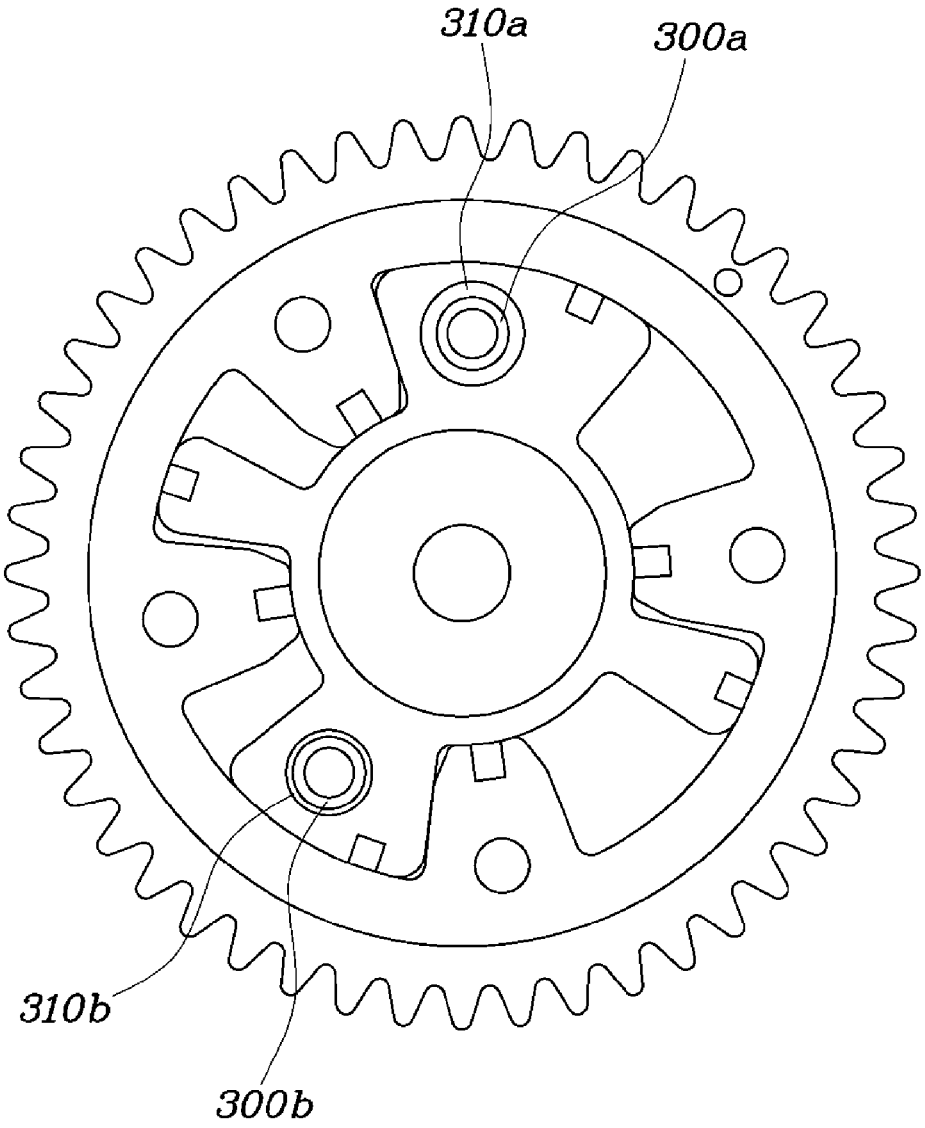
FIG. 4 is a view showing a lock pin and a lock pin hole.
Figure 5:
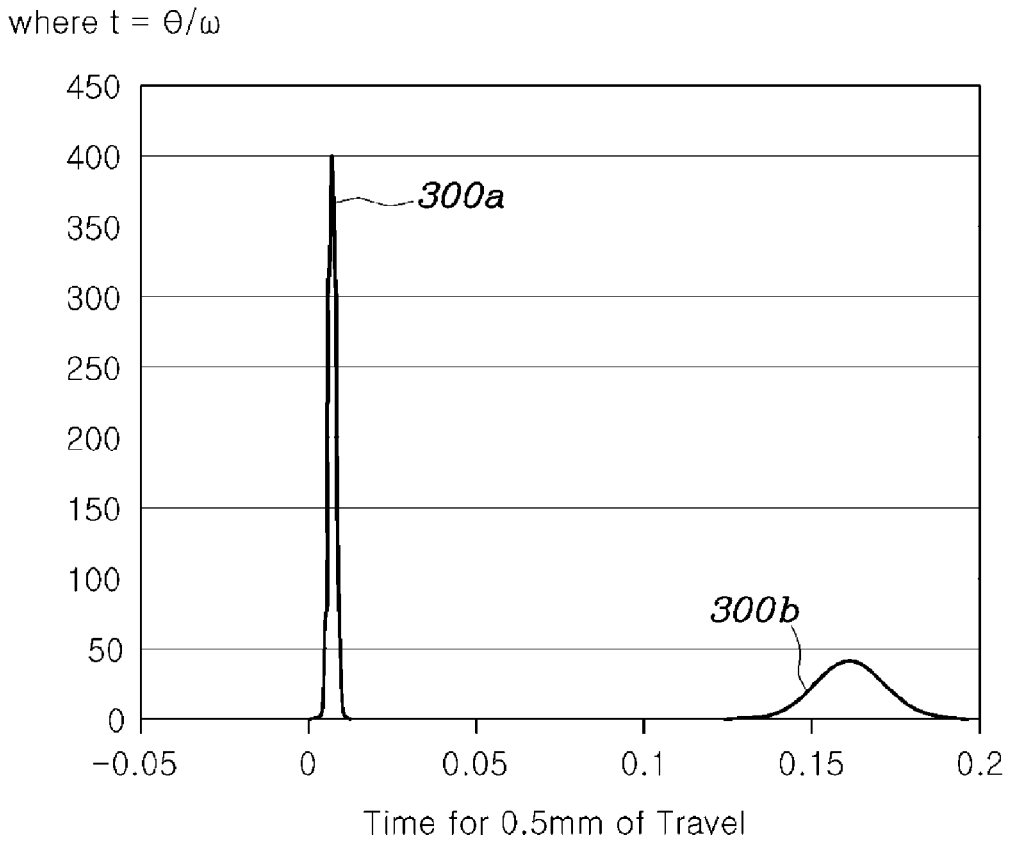
FIG. 5 is a graph showing a locking speed of a lock pin.
Figure 6:
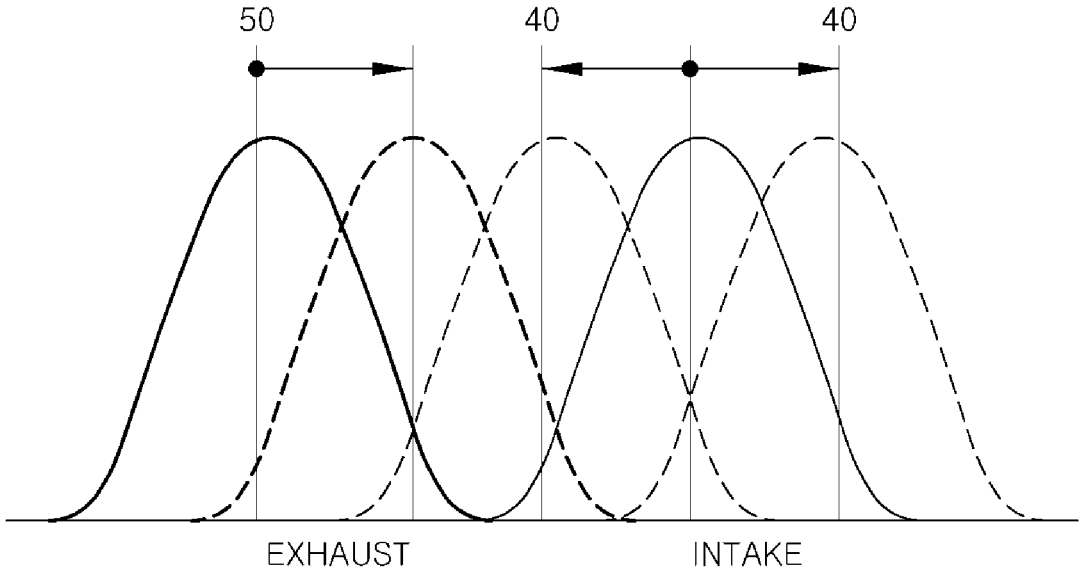
FIG. 6 is a graph showing the degree of advancing/retarding of intake and exhaust valves.
Figure 7:
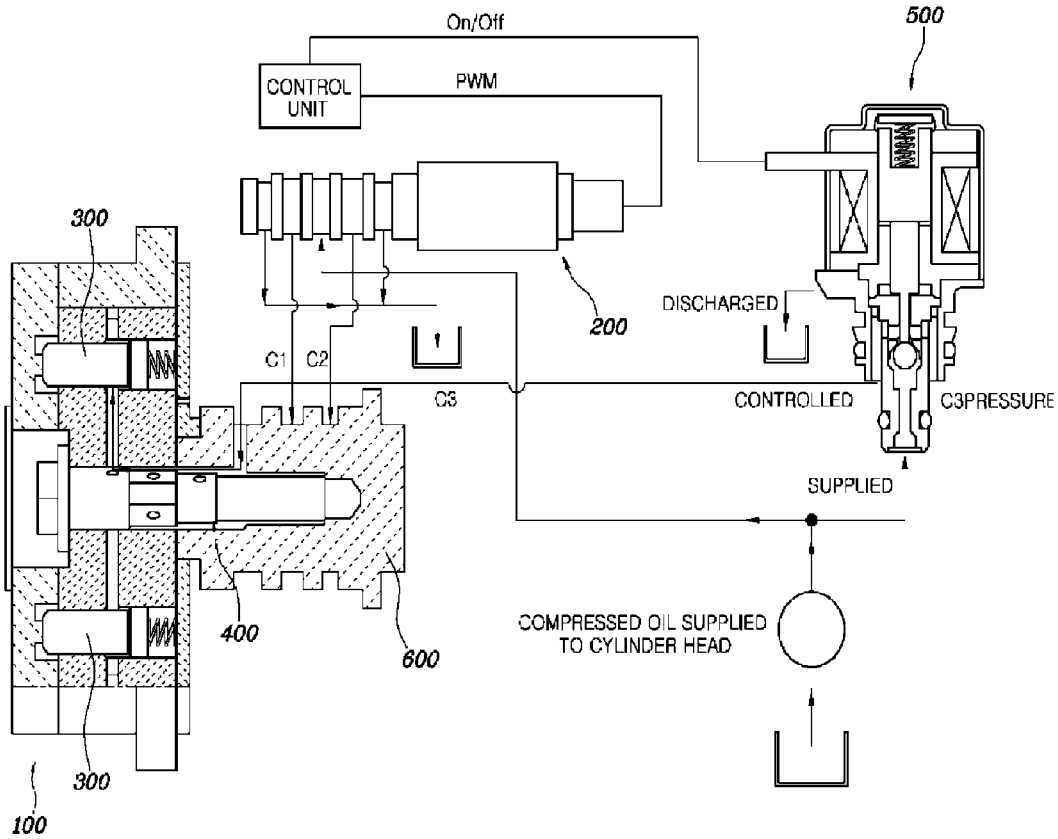
FIG. 7 is a view showing the entire configuration of a system according to the present disclosure.

FIG. 1 is a view showing a CVVT system according to one form of the present disclosure, and FIGS. 2 and 3 are views showing oil flow when an actuator 500 is operated/stopped. FIG. 4 is a view showing a lock pin 300 and a lock pin hole 310 and FIG. 5 is a graph showing a locking speed of the lock pin 300. FIG. 6 is a graph showing the degree of advancing/retarding of intake and exhaust valves and FIG. 7 is a view showing the entire configuration of a system according to the present disclosure.

A CVVT (Continuous Variable Valve Timing) system according to an embodiment of the present disclosure includes: an OCV 200 supplying oil received from a cylinder block into a CVVT 100; an oil supply unit 400 for supplying oil from the OCV 200 to a lock pin 300; and an actuator 500 selectively opening or closing the oil supply unit 400 such that oil is supplied to the lock pin 300 and the lock pin 300 is separated from a lock pin hole when the oil supply unit 400 is opened.

CVVTs generally have a structure that is controlled by one OCV such that a lock pin is automatically separated, when hydraulic pressure passing through the OCV is sufficient. According to the present disclosure, the actuator 500 is additionally provided in conjunction with the OCV 200 to separately control the lock pin 300 via oil supply through the OCV 200.

In one form of the present disclosure, a plurality of lock pins 300 may be provided at predetermined distances from each other. For example, two lock pins are provided and described in the present embodiment for easy understanding. The lock pins 300 fix a rotor and a stator when a continuous variable valve timing control is not performed. The lock pins 300 remove a phase difference between a cam and a crank so that the CVVT system is stopped, by being inserted into the lock pin holes 310 (FIGS. 2 and 3).

As shown in FIGS. 4 and 5, in the present disclosure, different lashes may be formed on the lock pins 300 to make the locking speeds of the lock pins 300 different. The forces for fixing the lock pins 300 may be different depending on the lashes. Any type of lash may be applied to the lock pins 300, but the lash is defined and described herein as the distances between the lock pins 300 and the lock pin holes 310.

The lashes may be formed by different diameters of the lock pin holes 310 each of which would receive the corresponding the lock pin 300. For example, the diameters of the lock pins 300 may be the same, but the diameters of the lock pin holes 310 are different, so the distances between the lock pins 300 and the lock pin holes 310 are different and thus different lashes are formed. Therefore, the lock pin 300 that is inserted into the corresponding lock pin hole 310 having a larger diameter (i.e., forming a larger lash) reaches more quickly the lock pin hole 310, so the locking speed is high. Further, since the diameter of the lock pin hole 310 is large, the lock pin 300 can be easily inserted and locked.

In contrast, the locking speed of the lock pin 300 that is inserted into the lock pin hole 310 having a smaller diameter (i.e., forming a smaller lash) is lower than that of the lock pin 300 that is inserted into the lock pin hole 310 having a larger lash. Since there is a small lash between the lock pin 300 and the lock pin hole 310 having the smaller diameter, the lock pin 300 can keep being stably fixed without shaking after being locked. Accordingly, unlike the related art, by applying different diameters to the lock pin holes 310 for the lock pins 300, it is possible to quickly lock a lock pin 300 and stably fix other lock pin 300.

Further, since the oil supply unit 400 is specifically provided in an oil channel 430 that is provided in CVVTs and selectively opened or closed by the actuator 500, oil supply to the lock pins 300 is controlled by the actuator 500. That is, the oil supply unit 400 is the oil channel 430 allowing oil supplied to a cam journal 600 to flow to the lock pins 300. In particular, the oil supply unit 400 may be a valve bolt that has a spool 410 therein and forms the oil channel 430 between the oil supply unit 400 and the cam journal 600 when the spool 410 is operated.

When the actuator 500 is operated, the spool 410 of the oil supply unit 400 is pressed by the actuator 500 and forms the oil channel 430 through which oil can flow to the lock pins 300. The flow course of oil is described with reference to FIGS. 1 to 3. FIGS. 1 and 2 show the course of supplied oil when the actuator 500 is operated to control the CVVT 100, in which oil supplied to the OCV 200 through a cylinder block from an oil pump is supplied to the cam journal 600 by the OCV 200. The oil supplied to the cam journal 600 presses the spool 410 of the oil supply unit 400 by the actuator 500, so the oil channel 430 is formed between the oil supply unit 400 and the cam journal 600. Accordingly, the oil is supplied to the lock pins 300 through the oil channel 430 and the lock pins 300 are pressed by the pressure of the oil, so the lock pins 300 are separated from the lock pin hole 310 and the CVVT 100 can be controlled.

As illustrated in FIG. 3, when the actuator 500 is not operated, even if oil is supplied through the OCV 200, the spool 410 is not operated, so the oil is not supplied to the lock pins 300 and drained and the lock pins 300 are inserted and locked into the lock pin holes 310.

The above description is shown in the entire system in FIG. 7. The control unit sends an on/off signal to the actuator 500 and a PWM signal to the OCV 200. Oil compressed by the oil pump is supplied to a cylinder head, the actuator 500, and the OCV 200 and moved in response to a signal from the control unit, so the CVVT is operated.

The present disclosure provides an intermediate phase CVVT system that can be applied to an inline 4 cylinder engine. Further, valve timing is positioned at an intermediate position in non-operation period of a CVVT such as in stopping or idling of an engine, so stopping an engine or a problem in idling is prevented and LIVC (Lift Intake Valve Closing) is performed by operating the CVVT while a vehicle is driven, and accordingly, fuel efficiency is improved. Further, as shown in FIG. 6, it is possible to retard an exhaust valve and advance and retard an intake valve, so an engine can be operated in a desired state and the lifespan of the engine can be increased. Furthermore, valve overlap can be freely set, so fuel efficiency is improved.

Although embodiments of the present disclosure have been described for illustrative purposes, those skilled in the art will appreciate that various modifications, additions and substitutions are possible, without departing from the scope and spirit of the present disclosure as disclosed in the accompanying claims.

What is claimed is:

1. A CVVT (Continuous Variable Valve Timing) system comprising:

an Oil Control Valve (OCV) configured to supply an oil received from a cylinder block into a CVVT;

an oil supply unit configured to supply the oil from the OCV to at least one lock pin; and an actuator configured to selectively open or close the oil supply unit such that the oil is supplied to the at least one lock pin and the at least one lock pin is separated from at least one lock pin hole when the oil supply unit is opened, wherein the oil supply unit is a valve bolt that includes a spool therein and forms an oil channel between the oil supply unit and a cam journal when the spool is operated.

2. The CVVT system according to claim 1, wherein the oil supply unit is an oil channel configured to supply oil to the cam journal from the OCV to said at least one lock pin.

3. The CVVT system according to claim 1, wherein the spool of the oil supply unit is pressed and operated by the actuator, so the oil channel configured to flow oil to said at least one lock pin is formed.

4. The CVVT system according to claim 1, wherein said at least one lock pin comprises at least two lock pins, and said at least two lock pins are provided at predetermined distances from each other.

5. The CVVT system according to claim 4, wherein said at least two lock pins have different lashes, whereby locking speeds of said at least two lock pins are different.

6. The CVVT system according to claim 5, wherein said at least two lashes are formed by at least two lock pin holes receiving the at least two lock pins, and wherein diameters of the at least two lock pin holes are different.

7. The CVVT system according to claim 4, wherein said at least two lock pins and the corresponding lock pin holes have different lashes, so fixing forces of said at least two lock pins are different.

8. The CVVT system according to claim 1, wherein a lash is formed by a distance between said at least one lock pin and said at least one lock pin hole.

9. A Continuous Variable Valve Timing (CVVT) system comprising:

a stator and a rotor, at least two lock pin holes formed in one of the stator and the rotor;

at least two lock pins positioned between the stator and the rotor to selectively fix a position of the rotor relative to the stator by projecting into the at least two lock pin holes;

an oil supply unit configured to supply an oil to the at least two lock pins, the oil supply unit including a spool defining an oil channel through which the oil is supplied; and an actuator directly engaged with the spool to selectively open or close the oil supply unit such that the oil is supplied to the at least two lock pins and the at least two lock pins are separated from the least two lock pin holes when the oil supply unit is opened, wherein the oil supply unit is a valve bolt that includes the spool therein and forms the oil channel between the oil supply unit and a cam journal when the spool is operated.

* * * * *